US008013275B2

(12) United States Patent
Ng et al.

(10) Patent No.: US 8,013,275 B2
(45) Date of Patent: Sep. 6, 2011

(54) HAIR FLAT IRON WITH LIGHT SOURCE

(75) Inventors: Ki Churk Ng, Kowloon (HK); Yiu Kwong Wan, Tsuen Wan (HK); Thomas C. Maddocks, Racine, WI (US)

(73) Assignee: Andis Company, Sturtevant, WI (US)

( * ) Notice: Subject to any disclaimer, the term of this patent is extended or adjusted under 35 U.S.C. 154(b) by 358 days.

(21) Appl. No.: 12/259,606

(22) Filed: Oct. 28, 2008

(65) Prior Publication Data

US 2010/0101598 A1 Apr. 29, 2010

(51) Int. Cl.

| | |
|---|---|
| ***A45D 1/04*** | (2006.01) |
| ***A45D 1/06*** | (2006.01) |
| ***A45D 6/00*** | (2006.01) |
| ***B26B 19/46*** | (2006.01) |

(52) U.S. Cl. ..... 219/225; 132/224; 132/269

(58) Field of Classification Search ..... None
See application file for complete search history.

(56) References Cited

U.S. PATENT DOCUMENTS

| | | | | |
|---|---|---|---|---|
| 4,267,430 | A | 5/1981 | Downey | |
| 4,692,586 | A | 9/1987 | Fromm et al. | |
| 4,877,042 | A | 10/1989 | Downey | |
| 5,117,090 | A | 5/1992 | Askins | |
| 5,354,967 | A | 10/1994 | Barzilai et al. | |
| 5,434,386 | A | 7/1995 | Glenn et al. | |
| 5,725,600 | A * | 3/1998 | Caisey et al. | 8/103 |
| 5,749,379 | A | 5/1998 | Stillwagon et al. | |
| 5,837,972 | A | 11/1998 | Padilla | |
| 6,047,707 | A | 4/2000 | Johnson | |
| 6,173,718 | B1 * | 1/2001 | Okumoto et al. | 132/224 |
| 6,248,979 | B1 | 6/2001 | Cafaro | |
| 6,363,215 | B1 | 3/2002 | Cafaro | |
| 6,386,206 | B2 * | 5/2002 | Lee | 132/225 |
| 6,423,942 | B1 | 7/2002 | Liao | |
| 6,996,916 | B2 | 2/2006 | Cafaro | |
| 7,044,139 | B2 * | 5/2006 | Tong | 132/225 |
| 7,108,395 | B2 | 9/2006 | Correa | |
| 7,243,661 | B2 | 7/2007 | Lun et al. | |
| 7,380,556 | B2 | 6/2008 | Carballada et al. | |
| 2001/0013513 | A1 | 8/2001 | Chan | |
| 2005/0011533 | A1 | 1/2005 | Ruben | |
| 2005/0056631 | A1 | 3/2005 | Cha | |
| 2005/0098192 | A1 | 5/2005 | Cafaro | |
| 2005/0121050 | A1 | 6/2005 | Cha | |
| 2005/0183283 | A1 | 8/2005 | Evanyk et al. | |
| 2005/0198855 | A1 | 9/2005 | Cafaro et al. | |
| 2006/0077654 | A1 * | 4/2006 | Krieger et al. | 362/136 |
| 2007/0278205 | A1 | 12/2007 | Pencook | |
| 2008/0053982 | A1 * | 3/2008 | Ceva | 219/225 |
| 2008/0210255 | A1 | 9/2008 | Moll | |
| 2008/0223394 | A1 | 9/2008 | Maddocks et al. | |
| 2009/0044823 | A1 * | 2/2009 | Overend et al. | 132/211 |
| 2009/0260650 | A1 * | 10/2009 | Jung | 132/224 |

* cited by examiner

*Primary Examiner* — Joseph M Pelham
(74) *Attorney, Agent, or Firm* — Michael Best & Friedrich LLP

(57) ABSTRACT

A hair styling appliance including a first arm pivotable with respect to a second arm. Each arm has a respective housing and heat plate, the heat plate at least partially defines a styling portion of each arm. The appliance also includes a light source positioned to illuminate a work area adjacent the styling portions.

7 Claims, 9 Drawing Sheets

HAIR FLAT IRON WITH LIGHT SOURCE

BACKGROUND

The present invention relates generally to hair styling devices or applications, and more particularly to a hair styling iron.

Styling hair in a dimly lit area poses a variety of difficulties, including over- or under-application of heat to the hair. Light bulbs and other external illumination methods are frequently inadequate for proper work area visualization for a variety of reasons, including the light being cumbersome or insufficient to adequately light the hair being styled. Professionals or others styling hair may also use brushes or other tools to separate and manage the hair as it is being styled. When the work area and the hair being styled are insufficiently illuminated, inefficiencies in styling exist because the condition of the hair cannot be readily ascertained.

SUMMARY

In one embodiment, the invention provides a hair styling appliance including a first arm pivotable with respect to a second arm. Each arm has a respective housing and heat plate, the heat plate at least partially defining a styling portion of each arm. The appliance also includes a light source positioned to illuminate a work area adjacent the styling portions.

In another embodiment, the invention provides a hair styling appliance including a first arm connected to a second arm at a hinge, wherein each arm includes a housing, a handle portion proximate the hinge, and a styling portion opposite the hinge including a heat transmitting plate. A light source is positioned on the housing between the handle portion and the styling portion to illuminate a work area.

In yet another embodiment, the invention provides a hair styling appliance including a first arm having a heat transmitting plate partially defining a styling portion of the first arm and a second arm having a heat transmitting plate partially defining a styling portion of the second arm. The first arm is pivotable with respect to the second arm to bring the heat transmitting plates into abutting relation with each other. A light source is positioned proximate to the styling portions to direct light along an edge of the heat transmitting plates when in the abutting relation.

Other aspects of the invention will become apparent by consideration of the detailed description and accompanying drawings.

Figure 1:
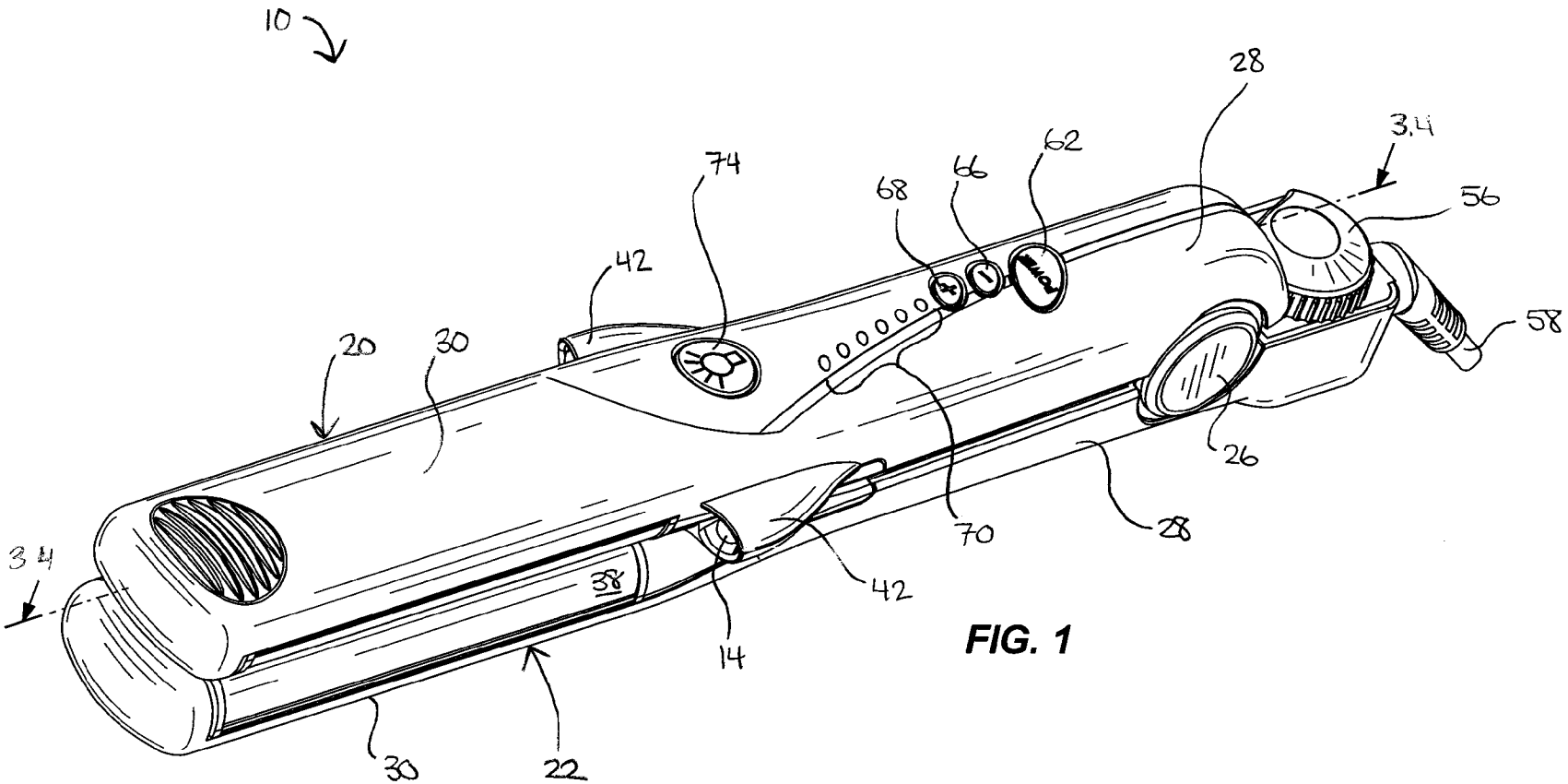
FIG. 1 is a top perspective view of a hair flat iron having a lighting arrangement according to an embodiment of the invention in a "closed" position.

Before any embodiments of the invention are explained in detail, it is to be understood that the invention is not limited in its application to the details of construction and the arrangement of components set forth in the following description or illustrated in the following drawings. The invention is capable of other embodiments and of being practiced or of being carried out in various ways. Also, it is to be understood that the phraseology and terminology used herein is for the purpose of description and should not be regarded as limiting.

DETAILED DESCRIPTION

FIGS. 1-7 illustrate a hair flat iron 10 having a built-in light source 14. In the illustrated embodiment, a light source 14 is positioned to illuminate a work area 16 on either side of the flat iron. The light source 14 may also be utilized with other hair styling devices, including a hair crimping iron, a hair styling iron, a hair curling iron, or the like.

Referring to FIGS. 1-7, the hair flat iron 10 includes a first arm 20 and a second arm 22 pivotably coupled to the first arm 20 at a spring-loaded hinge 26. Each arm 20, 22 of the flat iron 10 includes a handle portion 28 and a styling portion 32. The work area 18 is at least partially defined by the styling portions 32 of the first and second arms 20, 22. In the illustrated embodiment, the light source 14 is oriented such that light is generally directed along a longitudinal dimension of at least one of the arms 20, 22. The first arm 20 and second arm 22 may be constructed in various ways and, in the illustrated construction, include a similarly constructed first arm 20 and an opposite second arm 22. The first arm 20 and the second arm 22 may be constructed from numerous materials, including but not limited to, plastic, metal and the like.

Figure 2:
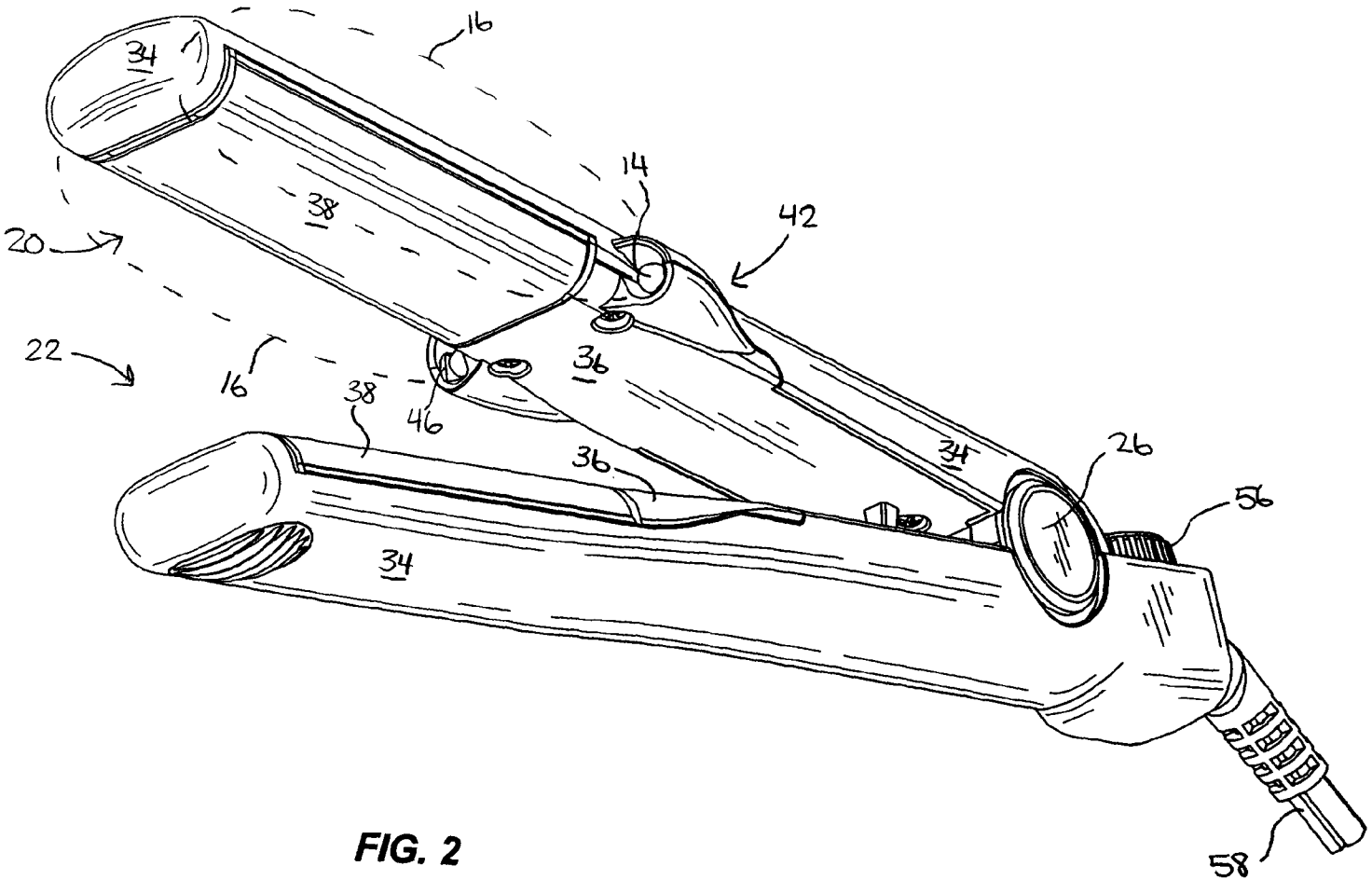
FIG. 2 is a bottom perspective view of the hair flat iron shown in FIG. 1 in an "open" position.
Figure 3:
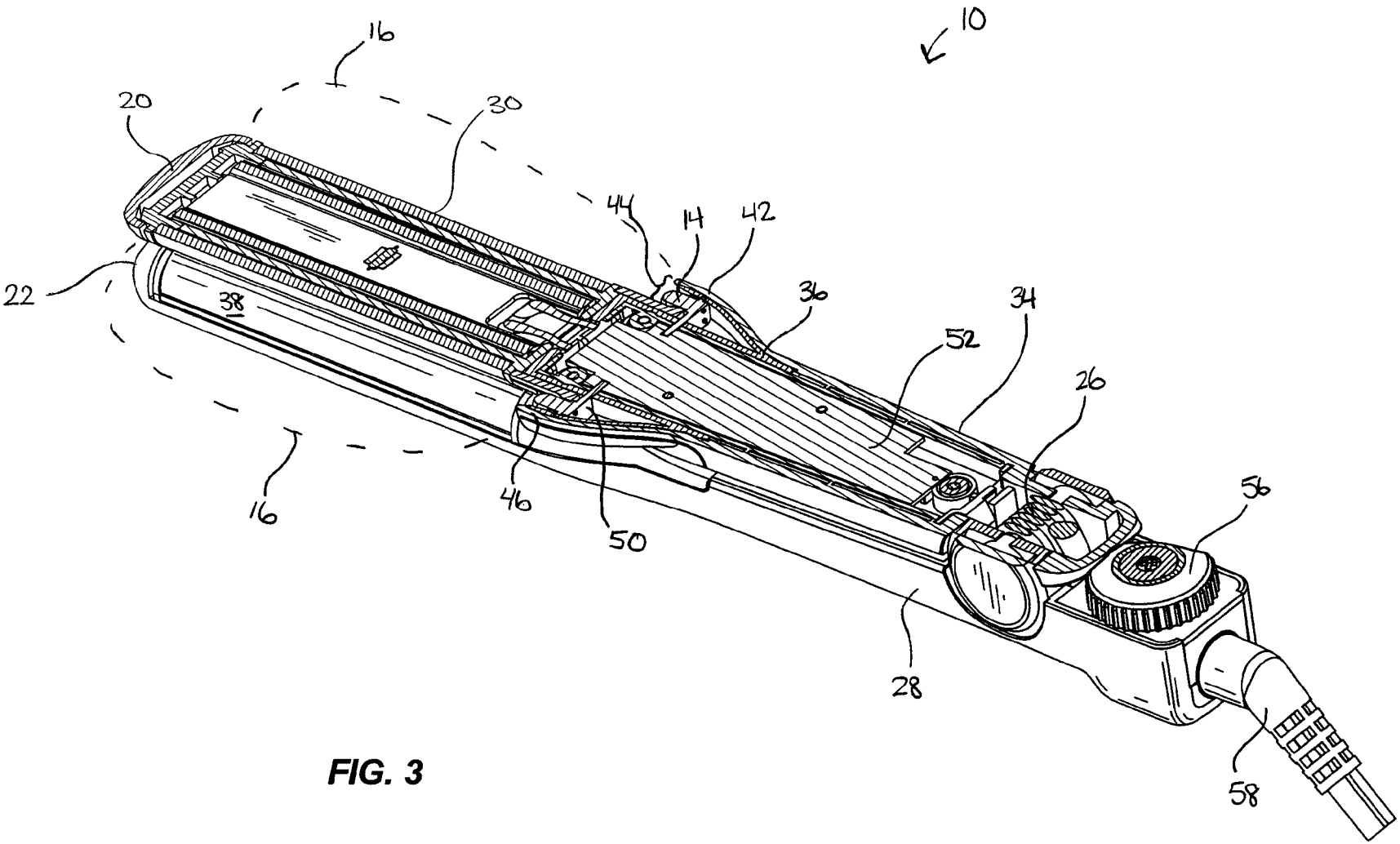
FIG. 3 is a top cross-sectional perspective view of the hair flat iron shown in FIG. 1.
Figure 4:
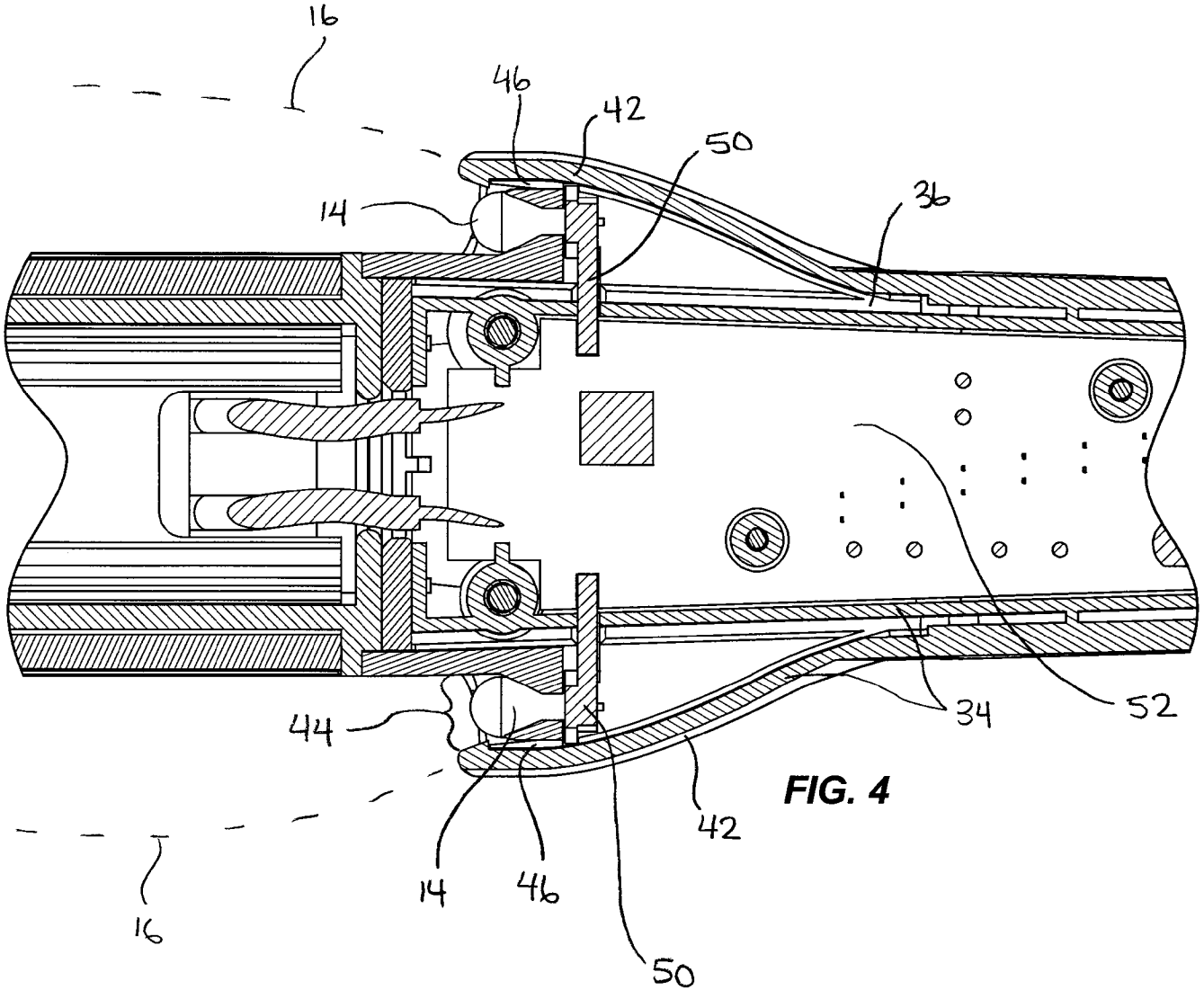
FIG. 4 is an enlarged cross-sectional view of the lighting arrangement of the hair flat iron shown in FIG. 1.
Figure 5:
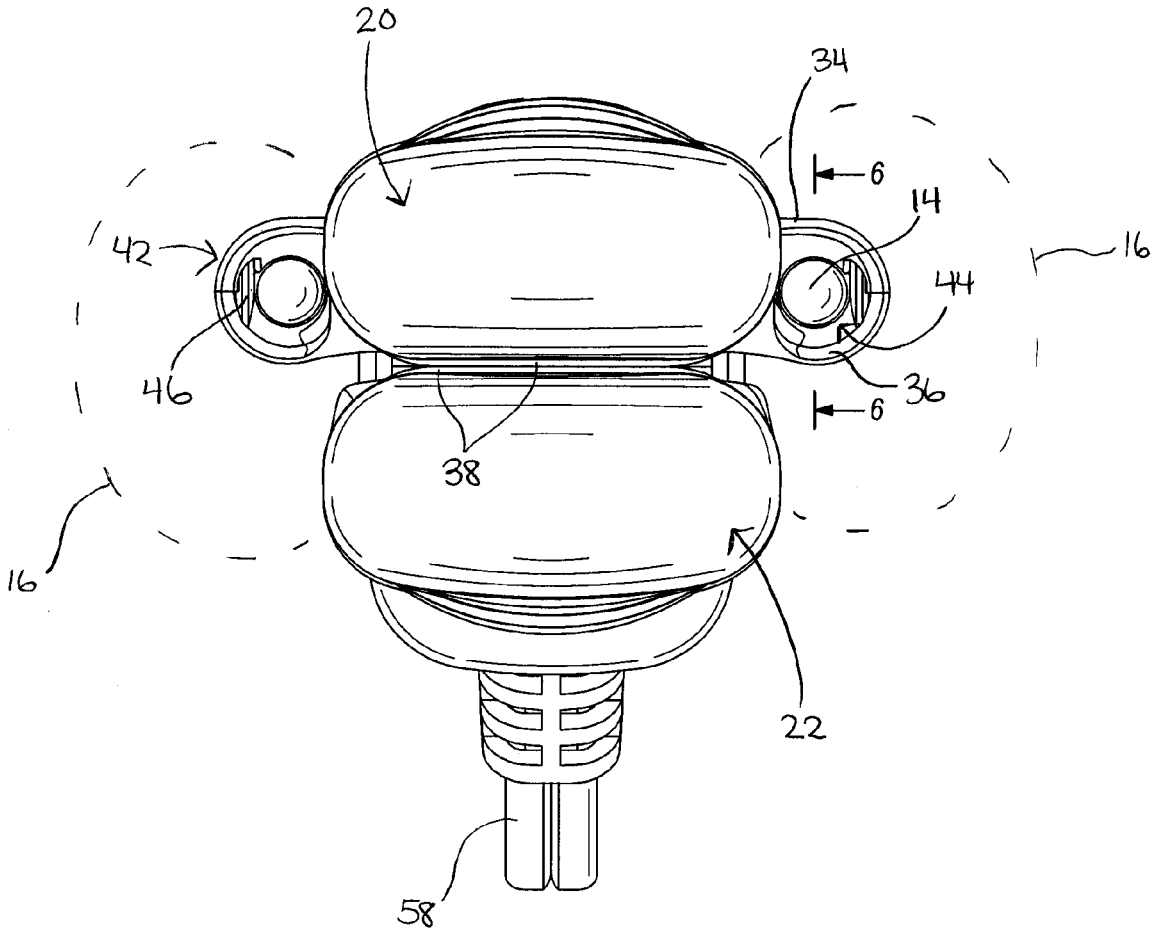
FIG. 5 is a front view of the hair flat iron shown in FIG. 1.
Figure 6:
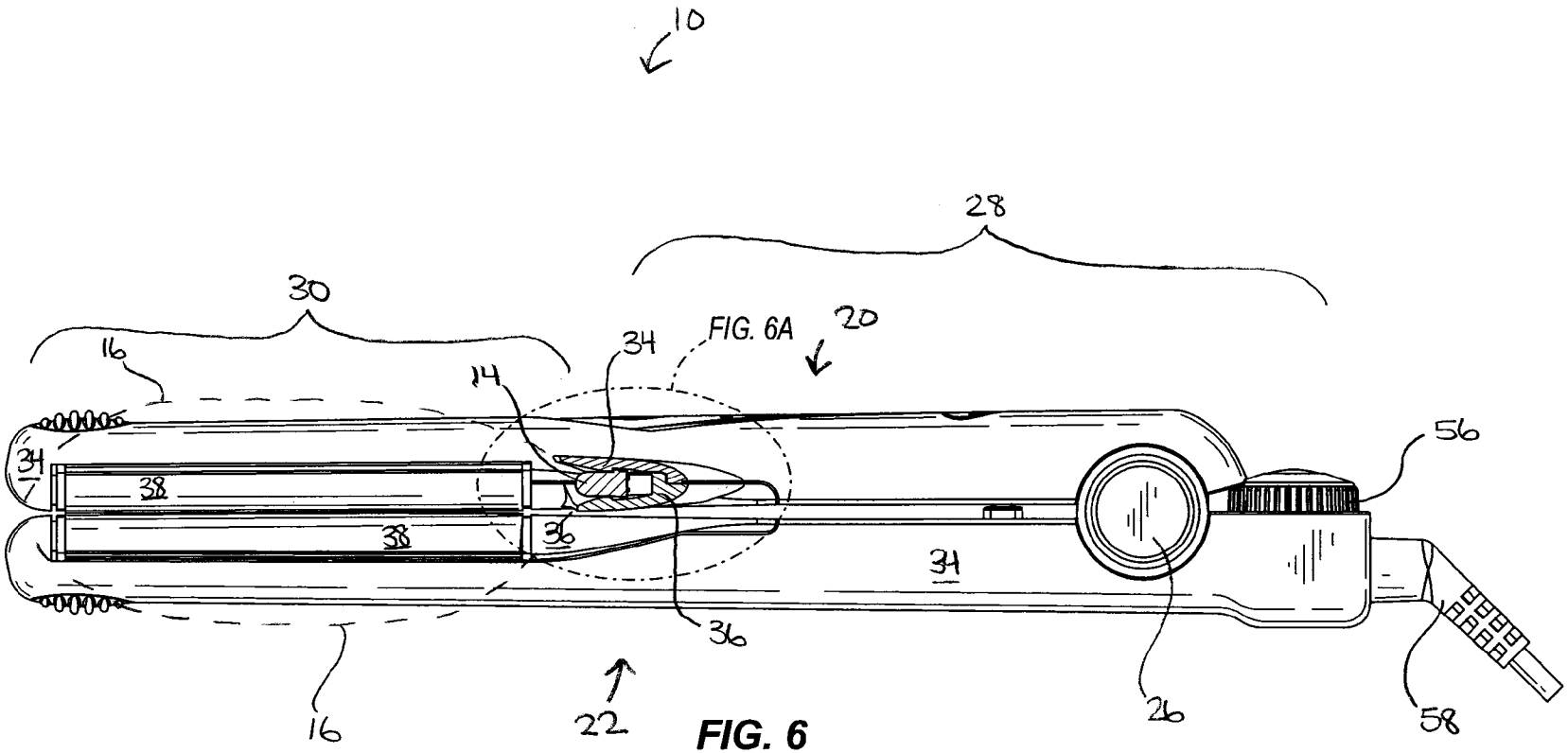
FIG. 6 is a side, partial cross-sectional view of the hair flat iron shown in FIG. 1.
Figure 6A:
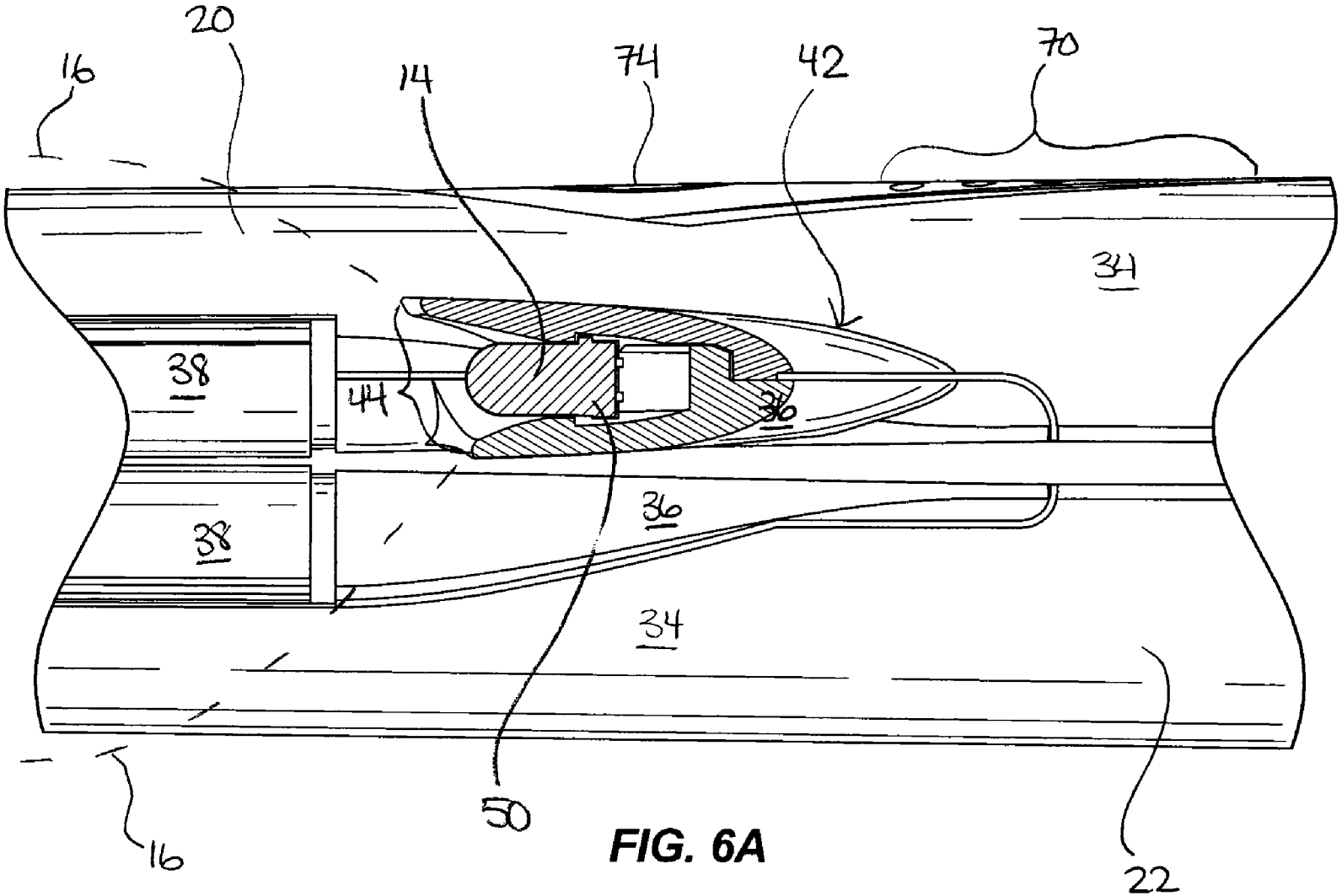
FIG. 6A is an enlarged view of the lighting arrangement of the hair flat iron shown in FIG. 6.
Figure 7:
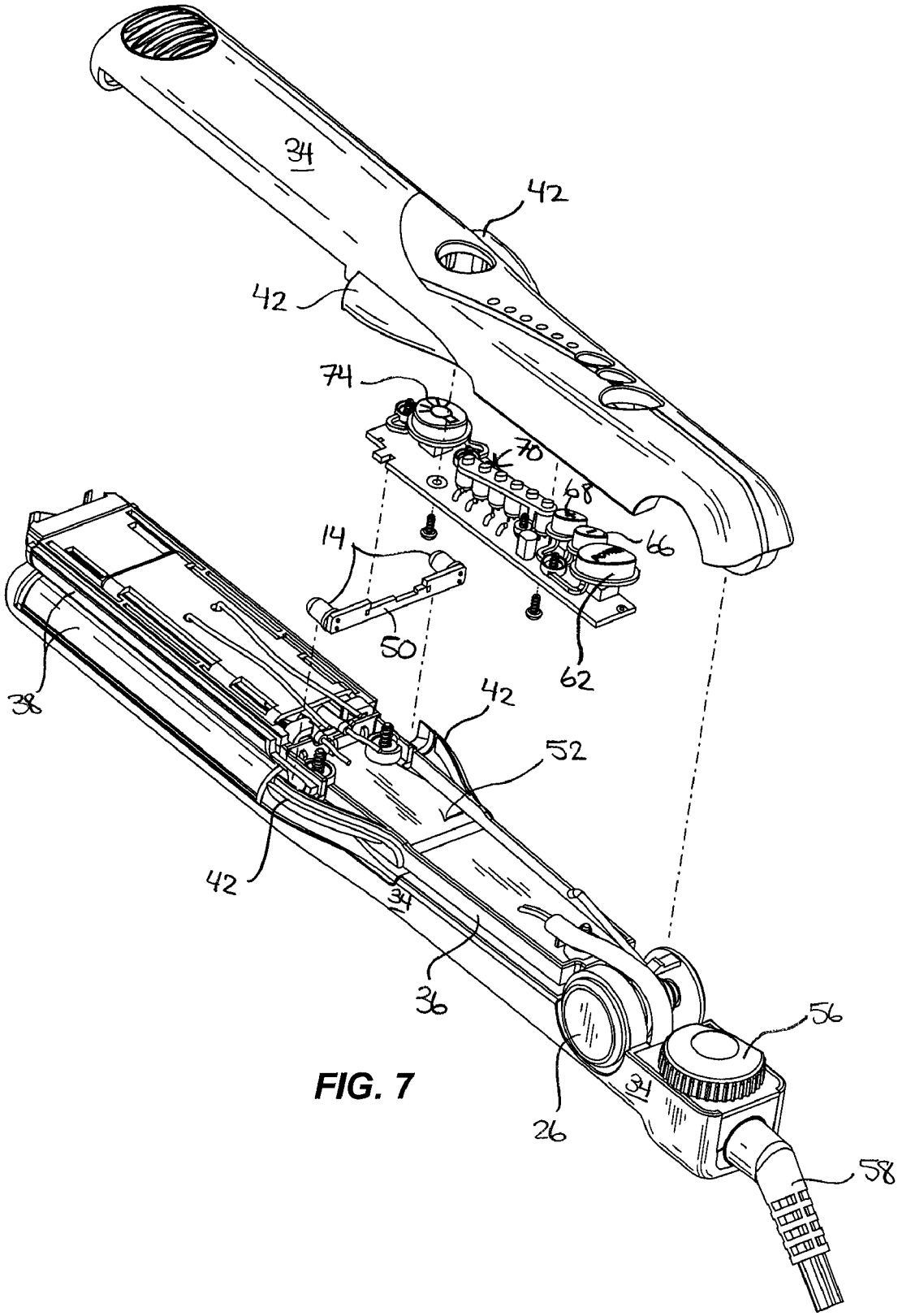
FIG. 7 is a partially exploded top perspective view of the hair flat iron shown in FIG. 1.

The spring-loaded pivot 26 couples the first arm 20 and the second arm 22 together proximate the handle portion 28. The spring-loaded pivot 26 operates to bias the second arm 22 away from the first arm 20 such that the first arm 20 and the second arm 22 are in an open position (FIG. 2). In further embodiments other means may be used for coupling the first and second arms 20, 22 together and/or biasing the second arm 22 away from the first arm 20.

In the illustrated embodiment, each arm 20, 22 is comprised of a housing including an outer housing piece 34 and an underbody housing piece 36, and an heat transmitting plate 38, which is located on the styling portion 32 of the respective arm 20, 22. The heat transmitting plates 38 are positioned on opposed surfaces of the first arm 20 and the second arm 22, such that the plates 38 are generally aligned and abut when the first arm 20 and the second arm 22 are in a closed position (FIGS. 1, 3 and 5-7). The outer housing piece 34 covers the majority of each arm 20, 22 (including the styling portion 30 and the handle portion 28), while the underbody housing piece 36 (FIG. 2) covers the underside of each arm 20, 22 from the heat transmitting plate 38 to the spring-loaded pivot 26 on the handle portion 28 of the hair flat iron 10. The housing pieces 34, 36 may be made from any number of materials, including, but not limited to plastic, metal and the like. Additionally, the housing and its associated components may be made by any number of processes, including, but not limited to injection molding, thermoforming, and the like. The heat transmitting plates 38 may be constructed from numerous materials, including but not limited to, metal and the like. The components of the arms 20, 22 can be secured together by fasteners, interference fits, adhesives, and the like.

In the illustrated embodiment of FIGS. 1-7, the first arm 20 includes a shroud 42 extending from opposite sides of the housing between the handle portion 28 and the styling portion 30. The shroud 42 is formed from mating surfaces of the outer housing piece 34 and the underbody housing piece 36. The shroud 42 provides a receptacle for the light source 14, and defines an aperture 44, through which the light emanating from the light source 14 is directed. In a further embodiment, any number of shrouds 42 are provided on the flat iron 10 to support light sources 14. In a still further embodiment, the light sources 14 are positioned elsewhere on the flat iron 10 to illuminate the work area 16. For example, the light sources 14 may be positioned on either of the first and second arms 20, 22, and/or at an end of the arm distal to and directed toward the spring-loaded pivot 26. In a further embodiment, the light sources 14 are positioned at a different location within the housing 34, and the light is directed to illuminate the work area 16 via a fiber-optics material. The fiber-optics material may be provided at either/both end(s) of the styling portion 30 and/or extends along at least one side of the styling portion 30 of the flat iron 10 adjacent to a respective edge of the heat transferring plate 38.

In the illustrated embodiment, the light source 14 is a high intensity, white light-emitting diode (LED), although any number of light colors may be used. The LEDs also allow for cool running temperatures of the light sources 14 and operate on low amounts of power. The LED is able to withstand the high temperature environment adjacent the heat transferring plates and other heating elements contained in the housing. In a further embodiment, the light source 14 can be any other type of light source such as light bulbs (e.g., incandescent, neon, etc.), light tubes, or the like.

As shown in FIGS. 2-5, the shroud 40 also provides a receptacle for a reflector 46, which further directs and focuses the light from the light source 14 on the work area 16 adjacent the heat transferring plates 38. The reflector 46 is retained in a slot in the shroud 40 formed by the outer housing piece 34 and the underbody housing piece 36. In a further embodiment, the reflector 46 is retained in position by other means including fasteners, adhesives, or the like. In the illustrated embodiment, the reflector 46 is a generally planar piece positioned on the distal side of the aperture 44 from the arm 20. In a further embodiment the reflector 46 may be more than one piece, be non-planar, and/or either partially or substantially encircle the light source 14. In a still further embodiment, the reflector 46 is integrally formed with one or more of the components that form the shroud 40.

As most clearly shown in FIGS. 3, 4, 6A and 7 the light source 14 of the illustrated embodiment is mounted on a support 50 that extends from within the shroud 42 into a cavity 52 defined by the housing in the handle portion 28 in a direction perpendicular to the longitudinal dimension of the first arm 20. The support 50 is primarily held in place by the underbody housing piece 36, which extends into the outer housing piece 34 in the handle portion 28 of the flat iron 10. In the illustrated embodiment, the support 50 spans the cavity 52 into the shrouds 42 positioned on either side of the housing thereby connecting the two light sources 14. The connection may be structural, electrical, or both. For example, if the support 50 is a printed circuit board (PCB), electricity is supplied to both light sources 14 via common electrical connections provided by the PCB. In a further embodiment of the invention, any number of light sources 14 may be mounted on the support 50, or separate supports 50 are provided for mounting each of the light sources. Alternatively or in addition, the support 50 can be held in place by another component of the arm 20 (e.g., the outer housing piece 34) or by multiple components including fasteners, adhesives, and the like. In a still further embodiment, the light source 14 is be mounted directly to the housing, a portion of the housing, or other the main circuit board via an integral socket or similar structure, thereby eliminating the necessity of a separate support 50.

As illustrated in FIG. 2, the spring-loaded hinge 26 of the hair flat iron 10 is positioned between the outer housing pieces 34 of the first and second arms 20, 22. Adjacent the hinge 26 is a rotary lock member 56 located on an inner surface of the second arm 22 and configured to engage an inner surface of the first arm 20 to lock the arms 20, 22 in the "closed" position as shown in FIGS. 1 and 3-7. Referring to FIG. 2, in the "open" position, the first arm 20 and the second arm 22 are positioned such that the heat transmitting plates 38 are spaced apart. The open position allows a user to insert hair between the plates 38 to be styled. To move the first arm 20 to the "closed" position, an operator applies a clamping pressure to the first and second arms 20, 22 to overcome the spring-loaded hinge 26, thereby moving the styling portion 30 of the first arm 20 in a pivoting motion toward the styling portion 30 of the second arm 22. Referring to FIG. 1, in the "closed" position, the heat transmitting plates 38 of the first and second arms 20, 22 are in abutting relation to each other to style, and in particular, straighten the hair captured therebetween. In the "closed" position, no additional hair can be inserted between the plates 38.

The hair flat iron 10 includes an electrical cord 58 extending from the end of the handle portion 28 distal to the styling portion 30 for electrically connecting the hair flat iron 10 to an external power source (not shown). The electrical power includes an alternating current (AC) power provided via a corded plug electrically coupled to a wall outlet. In a further embodiment, direct current (DC) power provided by a battery (e.g., a rechargeable battery disposed in the handle or housing of the hair grooming device). Hair styling devices powered by AC and/or DC power are generally known in the art and, accordingly, are not discussed further herein.

As shown in FIG. 1, the hair flat iron 10 includes a user interface comprising a number of buttons and indicators (interface components). Specifically, the user interface of the illustrated embodiment has a power button 62, a decrease (–) temperature button 66, an increase (+) temperature button 68, temperature indicators 70, and a light source button 74. In the illustrated embodiment, the indicators 70 are constituted by an array of LEDs positioned within the housing that are visible through an array of distinct transparent regions in the housing. In a further embodiment, the temperature indicators 70 can be any type of visual display including a liquid crystal display (LCD), a variable-intensity light, a numerical display, etc. The buttons 62, 66, 68, and 74 of the illustrated embodiment are flex-film push buttons. In a further embodiment, one or more of the buttons may be dials, switches, other types of buttons, or the like. Alternatively or in addition, fewer or more interface components can be provided, and still further, one or more of the components can be combined physically and/or functionally.

The user interface is located on the outer housing piece 34 of the first arm 20, substantially on the handle portion 28 of the hair flat iron 10. This arrangement facilitates the design and manufacture of the device because the buttons 62, 66, 68, and 74 and plurality of indicators 70 are positioned adjacent the cavity 52 in which the electrical circuitry is housed. In a further embodiment, the user interface can be positioned elsewhere on the flat iron 10 and/or have components positioned remotely from each other.

Figure 8:
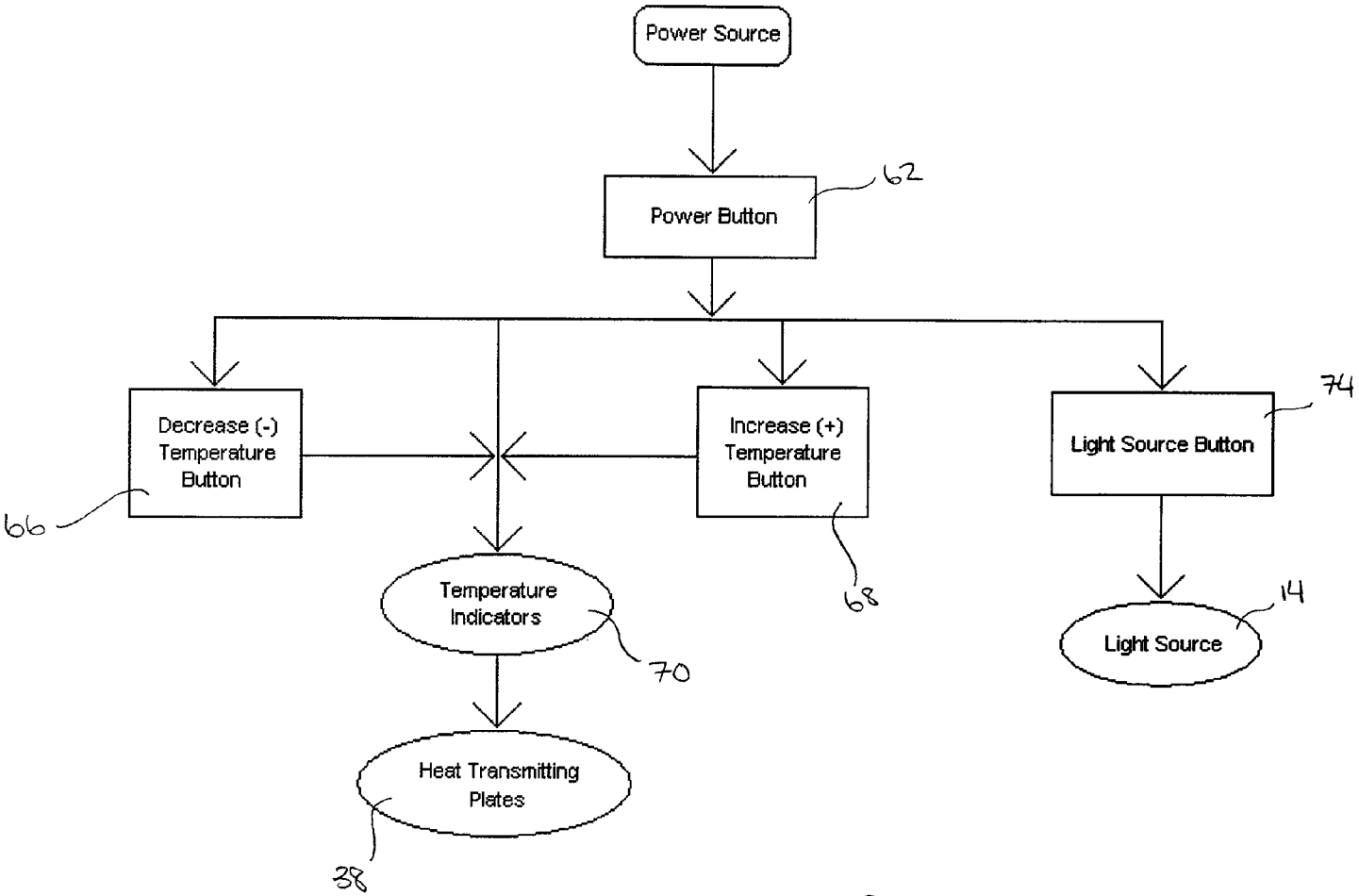
FIG. 8 is a diagram illustrating the operation of the hair flat iron according to an embodiment of the invention.

In operation of the illustrated embodiment, and as shown in FIG. 8, the power button 62 allows or prevents electricity from flowing from a power source to the other circuit elements of the hair flat iron 10. In the "power on" state, electricity flows to each of the decrease (–) temperature button 66, the increase (+) temperature button 68, the light source button 74, the temperature indicators 70, and the heat transmitting plates 38.

The light source button 74 allows or prevents electricity from flowing to the light source 14 depending on its state (i.e., "on" or "off"). In the "light on" state, electricity flows to the light source and the light source 14 is illuminated. In a further embodiment, the light source may have more than two states. For example, if the amount of electricity supplied to the light source 14 is regulated, the illumination provided to the work area 16 is consequently increased or decreased, and this regulation (i.e., switching between the multiple states) is controlled via the light source button 74. In the illustrated embodiment, both light sources 14 are controlled via the light source button 74; however, in a further embodiment each light source may be individually controlled. In a still further embodiment, the light source 14 may be illuminated automatically when the flat iron 10 is turned "on" using the power button 62.

As shown in FIG. 8, in the "power on" state, electricity flows from the power source to the temperature indicators 70 and the heat transmitting plates 38. In the illustrated embodiment, a default medium heat setting is selected when the power button is turned "on" and half of the temperature indicators 70 are illuminated as a result to communicate this to a user. The temperature is elevated or lowered when the increase temperature button 68 or decrease temperature button 66 is selected, respectively. The number of temperature indicators 70 illuminated changes accordingly to indicate a higher or lower heat setting. In a further embodiment, the temperature setting is indicated with the same array of indicators 70 by changing which light is illuminated along the array, with one end being the lowest setting and the other end being the highest setting.

Other embodiments of the present invention may utilize combinations of the above embodiments. The embodiments described above and illustrated in the figures are presented by way of example only and are not intended as a limitation upon the concepts and principles of the present invention. As such, it will be appreciated by one having ordinary skill in the art that various changes in the elements and their configuration and arrangement are possible without departing from the spirit and scope of the present invention as set forth in the claims.

What is claimed is:

1. A hair styling appliance, the hair styling appliance comprising:

a first arm;

a second arm connected to the first arm at a hinge;

wherein each arm includes a housing, a handle portion proximate the hinge, and a styling portion opposite the hinge, the styling portion including a heat transmitting plate; and a plurality of light sources positioned on the housing of at least one of the first arm and the second arm between the handle portion and the styling portion to illuminate a work area.

2. The hair styling appliance of claim 1 wherein the heat transmitting plate on the first arm faces the heat transmitting plate on the second arm, and the work area lies adjacent to at least one edge of at least one of the first and second heat transmitting plates.

3. The hair styling appliance of claim 1 wherein a first light source of the plurality of light sources and a second light source of the plurality of light sources are positioned on opposite sides of the housing of at least one of the first arm and the second arm.

4. The hair styling appliance of claim 1 wherein at least one of the plurality of light sources is supported within a shroud formed by the housing.

5. The hair styling appliance of claim 4 wherein a reflector is positioned adjacent the at least one light source within the shroud.

6. The hair styling appliance of claim 1 wherein at least one of the plurality of light sources is an LED.

7. The hair styling appliance of claim 1 wherein the work area is selectively illuminated by actuation of a user interface component.

* * * * *